US005406756A

United States Patent [19]

Bemis et al.

[11] Patent Number: 5,406,756

[45] **Date of Patent: * Apr. 18, 1995**

[54] HINGED RAIN GUTTER

[75] Inventors: Peter F. Bemis, Sheboygan; Bradley J. Bruggink, Oostburg; Daniel Cykana, Sheboygan; Warren L. Stokdyk, Oostburg, all of Wis.

[73] Assignee: Bemis Manufacturing Company, Sheboygan Falls, Wis.

[ * ] Notice: The portion of the term of this patent subsequent to Jun. 8, 2010 has been disclaimed.

[21] Appl. No.: 929,946

[22] Filed: Aug. 14, 1992

Related U.S. Application Data

[63] Continuation-in-part of Ser. No. 610,522, Nov. 8, 1990, Pat. No. 5,216,852.

[51] Int. Cl.[6] ..... E04D 13/06; E04D 13/08

[52] U.S. Cl. ..... 52/16; 52/11; 52/12; 248/48.1

[58] Field of Search ..... 52/11, 12, 15, 16, 726.1; 248/48.1, 48.2; 405/124, 126, 118; 210/469, 474

[56] References Cited

U.S. PATENT DOCUMENTS

| | | | |
|---|---|---|---|
| 1,442,625 | 10/1919 | Lyth . | |
| 1,780,553 | 11/1930 | Flagge . | |
| 1,936,079 | 11/1933 | Belding | 108/28 |
| 2,271,081 | 1/1942 | Layton | 108/30 |
| 2,639,680 | 5/1953 | Tennison, Jr. | 108/28 |
| 2,988,226 | 6/1961 | Campbell | 52/12 |
| 3,060,638 | 10/1962 | Bender | 50/4 |
| 3,252,288 | 5/1966 | Tennison, Jr. | 61/15 |
| 3,388,555 | 6/1968 | Foster | 61/15 |
| 3,545,144 | 12/1970 | Sickler | 52/11 |
| 3,550,381 | 12/1970 | South | 61/15 |
| 3,611,731 | 10/1971 | Edmondson | 52/11 |
| 3,670,505 | 6/1972 | Weaver | 52/11 |
| 3,741,398 | 6/1973 | Abramson | 210/474 |
| 3,911,632 | 10/1975 | Bryfogle et al. | 52/13 |
| 3,913,284 | 10/1975 | Hall | 52/11 |
| 3,967,419 | 7/1976 | Robinson | 52/16 |
| 4,150,515 | 4/1979 | Giulini | 52/12 |
| 4,169,570 | 10/1979 | Morin | 248/48.2 |
| 4,257,716 | 3/1981 | Woodrow | 408/118 |
| 4,309,792 | 1/1982 | Faye | 16/389 |
| 4,313,693 | 2/1982 | Follows et al. | 405/121 |
| 4,418,504 | 12/1983 | Lassiter | 52/12 |
| 4,446,658 | 5/1984 | Gouin | 52/11 |
| 4,619,554 | 10/1986 | Walker et al. | 405/120 |
| 4,631,875 | 12/1986 | Olson | 52/12 |
| 4,632,342 | 12/1986 | Skinner | 248/48.2 |
| 4,646,487 | 3/1987 | Andersson | 52/11 |
| 4,727,689 | 3/1988 | Bosler | 52/12 |
| 4,858,396 | 8/1989 | Rose et al. | 52/11 |
| 4,912,888 | 4/1990 | Martin | 52/11 |
| 4,936,061 | 6/1990 | Palma | 52/12 |
| 4,954,015 | 9/1990 | McGowan | 405/121 |
| 4,959,932 | 10/1990 | Pfeifer | 52/12 |
| 5,003,732 | 4/1991 | Quinnell | 52/94 |

FOREIGN PATENT DOCUMENTS

| | | | |
|---|---|---|---|
| 506677 | 11/1978 | Australia . | |
| 717700 | 9/1965 | Canada . | |
| 1215208 | 12/1986 | Canada . | |
| 629220 | 9/1949 | United Kingdom . | |
| 1409684 | 10/1975 | United Kingdom . | |
| 2101168 | 1/1983 | United Kingdom . | |
| 2166464 | 5/1986 | United Kingdom . | |
| 2200184 | 7/1988 | United Kingdom | 52/16 |
| WO86/00104 | 1/1986 | WIPO . | |
| WO90/07619 | 7/1990 | WIPO . | |

*Primary Examiner*—Michael Safavi
*Attorney, Agent, or Firm*—Michael, Best & Friedrich

[57] ABSTRACT

A rain gutter assembly including an elongated rain gutter including an end and a channel extending longitudinally of the rain gutter, and a connecting member engaged with the end of the rain gutter and including a bayonet portion received in the channel. The rain gutter arranged with a grommet along a rear wall thereof and a mounting fastener engaged within the grommet so as to attach the rain gutter to a building wall. The rain gutter assembly including a downspout having a grommet secured to a rear wall thereof for supporting the downspout to the building wall.. With a mounting fastener slidingly engaging the grommet so as to attach the downspout to the building wall.

32 Claims, 8 Drawing Sheets

178
250
70
66
238
178
242
190
354
306
370
38
86
34
390
58
40
446
406
434
410
422
418
416
414
18
438
446
394
430
398
426
430
442
398
450
402
494
448
354
500
370
462
494
470
501
402
426
490
466
474
458
454
394

394
494
500
354
462
402
470
499
490
501
466
474
454
398

HINGED RAIN GUTTER

RELATED APPLICATIONS

This is a continuation-in-part of United States patent application Ser. No. 610,522 filed Nov. 8, 1990 now U.S. Pat. No. 5,216,852.

BACKGROUND OF THE INVENTION

1. Technical Field

The invention relates generally to rain gutter assemblies for collecting water and channeling collected water to a downspout.

2. Description of the Related Art

Rain gutter assemblies are typically mounted on a building to collect water falling from the roof of the building. The installation of a rain gutter assembly can be difficult because the relatively long length of the rain gutter sections and their weight can make handling and mounting of the rain gutter assembly awkward. The difficulty of assembling and mounting a rain gutter assembly is further complicated by the fact that most rain gutter assemblies are mounted on the building at a relatively high position.

Attention is directed to U.S. Ser. No. 610,522, which was filed Nov. 8, 1990 and which is incorporated herein by references.

SUMMARY OF THE INVENTION

The invention provides a rain gutter assembly including a rain gutter and a downspout that can be easily assembled and mounted on a building. Also, the gutter is easily unfolded for cleaning.

More particularly, the invention provides a rain gutter assembly comprising an elongated rain gutter including an end and means defining a channel extending longitudinally of the rain gutter, and a connecting member engaged with the end of the rain gutter and including a bayonet portion received in the channel.

One embodiment of the invention provides a rain gutter assembly adapted to be mounted on a building wall, the rain gutter assembly comprising a rain gutter including a wall, a fastener for securing the rain gutter wall to the building wall, and means for selectively holding the fastener in position relative to the rain gutter prior to securing the rain gutter to the building wall.

One embodiment of the invention provides a one-piece, extruded rain gutter comprising a rear wall having a length, a trough portion having a length, a connecting member having a length, means including a first integral hinge extending substantially the entire length of the rear wall and the trough portion for flexibly and integrally connecting the rear wall and the trough portion, and means including a second integral hinge extending substantially the entire length of the trough portion and the connecting member for flexibly and integrally connecting the trough portion and the connecting member, the hinges allowing the gutter to be laid open in a substantially flat position so as to be easily stacked for storage and handling.

One embodiment of the invention provides an extruded rain gutter comprising a rear wall including an upper edge, a front wall including a vertical portion having an upper edge and a horizontal portion extending rearwardly from the upper edge of the vertical portion and including a rearward edge having a length, a connecting web having a length, a forward edge, and a rearward edge, an integral hinge extending substantially the entire length of the connecting web and substantially the entire length of the horizontal portion for flexibly and integrally connecting the forward edge of the connecting web and the rearward edge of the horizontal portion, and means for selectively securing the rearward edge of the connecting web to the vertical edge of the rear wall.

One embodiment of the invention provides a rain gutter assembly comprising an elongated rain gutter having an end, a front wall having an upper edge, and a rear wall having an upper edge, a connecting web, means for connecting the rain gutter and the connecting web and for affording movement of the connecting web into a closed position wherein the connecting web extends between the upper edge of the rear wall and the upper edge of the front wall, a member connected to the end of the rain gutter and having a portion partially overlapping the front wall, and means on the connecting web for clamping the overlapping portion of the member against the front wall in response to movement of the connecting web into the closed position.

One embodiment of the invention provides an extruded rain gutter comprising a rear wall including an upper edge, a forward wall including an upper edge, and a one-piece, elongated leaf guard connecting the upper edges of the rearward and forward walls, the leaf guard including a plurality of apertures and a strengthening support web extending the length of the leaf guard in an uninterrupted zig-zag pattern.

One embodiment of the invention provides a rain gutter assembly adapted to be mounted on a building for collecting water, the assembly comprising a rain gutter adapted to contain water, means including a first grommet and a fastener in the grommet for securing the rain gutter to the building, a downspout for draining water from the rain gutter, and means for supporting the downspout on the building, the downspout support means including a second grommet which is substantially identical to the first grommet and which is adapted to hold a fastener for securing the second grommet to the building, and means for mounting the downspout on the second grommet.

One embodiment of the invention provides a rain gutter assembly adapted to be mounted on a building, the rain gutter assembly comprising a rain gutter adapted to contain water, a downspout for draining water from the rain gutter, a projection extending from the building, and means for supporting the downspout, the means including means on the downspout for slidingly engaging the projection on the building.

One embodiment of the invention provides a method for mounting a rain gutter on a building for collecting water, the method comprising the steps of: temporarily securing a fastener to the rear wall of a rain gutter, positioning the rear wall of the rain gutter against the building, and utilizing the fastener to permanently fasten the rear wall of the rain gutter to the building.

One embodiment of the invention provides a method for mounting a rain gutter assembly on a building for collecting water, the method comprising the steps of: fastening a first length of rain gutter in a laid-open position to the building, securing a connector member to an end of the first length of rain gutter, securing an end of a second length of rain gutter in a laid-open position to the connector, and fastening the second length of rain gutter to the building.

One embodiment of the invention provides an extruded rain gutter comprising a rear wall, a front wall, a leaf guard connecting the rear wall and the front wall, the leaf guard having a length and a lower surface and having therein holes allowing water to flow into the gutter, and means for preventing water from traversing the lower surface, the means including a projection extending downwardly from the lower surface of the leaf guard and extending along the length of the leaf guard.

One of the features of the invention is the provision of channels located in the ends of rain gutter sections and connecting members having bayonet portions received by the channels.

Another feature of the invention is the provision of a capturing tab located on the undersurface of a hinged leaf guard and a connecting member that is engaged by the capturing tab when the leaf guard is closed.

Another feature of the invention is the provision of slots in the rear wall of the rain gutter sections and grommets extending through the slots to support the rain gutter sections on a wall of a building. The grommets are selectively captured by the slots of the rain gutter and therefore can be assembled with the rain gutter prior to mounting the rain gutter on the building wall.

Another feature of the invention is the provision of a rain gutter having a high-strength leaf guard design that prevents water falling onto the leaf guard from overflowing the leaf guard or from being drawn away from the gutter along the leaf guard by surface tension.

Another feature of the invention is the provision of a downspout that communicates with a rain gutter and that is supported on a wall by a grommet that is the same as that used to support the rain gutter.

Another feature of the invention is the provision of rain gutter assembly including a downspout connector for supporting the downspout on a wall by sliding the downspout connector over a projection extending from the wall.

Another feature of the invention is the provision of a method of assembly affording relatively easy assembly and mounting of the rain gutter and the downspout.

Another feature of the invention is an extruded rain gutter having a leaf guard and a living hinge that flexibly and integrally connects the leaf guard and the front wall of the rain gutter. The living hinge is located in a position that reduces stress and minimizes wear on the living hinge.

Another feature of the invention is the provision of a rain gutter assembly including a folding rain gutter, a connector that can be snapped into engagement with the rain gutter, and a gasket that is compressed between the rain gutter and the connector when the rain gutter is folded up.

Various other features and advantages of the invention will become apparent to those skilled in the art upon review of the following detailed description, claims and drawings.

BRIEF DESCRIPTION OF THE DRAWINGS

FIG. 18 is a front elevational view in partial cross-section of rain gutter section and a connector member connected to the rain gutter section.

Figure 1:
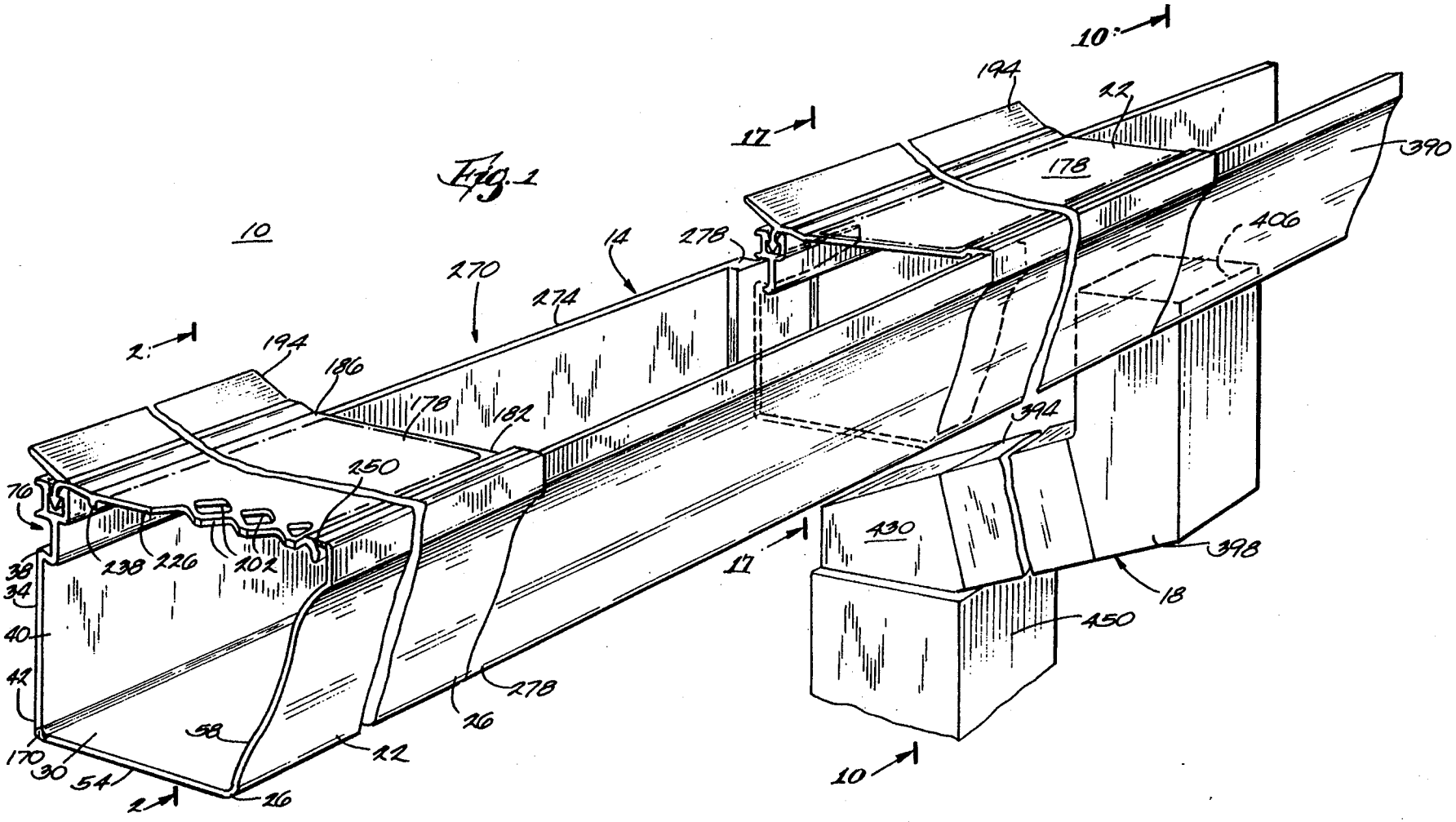
FIG. 1 is a perspective view of a rain gutter assembly embodying the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

A rain gutter assembly 10 embodying various features of the invention is illustrated in the drawings. As shown in FIG. 1, the rain gutter assembly 10 includes a rain gutter 14 and a downspout 18, each of which can be mounted on the side of a building below a sloped roof so as to collect water falling from the roof of the building and to channel collected water to the downspout 18.

As best shown in FIG. 1, the rain gutter 14 includes first and second elongated, mutually aligned rain gutter sections 22. The rain gutter sections 22 are substantially identical and each has opposite ends 26. Each rain gutter section 22 includes an inner surface 30 which provides a trough-like cross-sectional configuration in a plane generally perpendicular to the length of the rain gutter 14.

Each rain gutter section 22 includes a generally vertically disposed rear wall 34 having a main portion 40 including an upper edge 38 and a lower edge 42. The rear wall 34 also has (FIG. 2) an outer, generally planar mounting surface 46 which faces the side of the building. The inner surface of the rear wall 34 faces oppositely from the mounting surface and away from the building.

Each rain gutter section 22 also includes (FIG. 1) an elongated, generally rigid trough portion 50 having a bottom wall 54 and a front wall 58. The bottom wall 54 is generally horizontal and has a rearward edge 62 connected to the lower edge 42 of the rear wall 34 in a manner described below. The front wall 58 is integrally formed with the bottom wall 54 and extends generally perpendicular to and upwardly from the bottom wall 54. The front wall 58 includes (FIG. 2) an upper edge 60 that extends substantially the entire length of the rain gutter section 22. The front wall 58 also includes a horizontal portion or lip 66 that is integrally formed with the front wall 58 and that extends rearwardly from the upper edge 60. The horizontal lip 66 has a rearward edge 70 extending substantially the entire length of the rain gutter section 22.

With the rear wall 34, the trough portion 50 gives the inner surface 30 of the rain gutter section 22 the trough-like cross-sectional configuration and provides the rain gutter section 22 with an outer surface that is generally uniform along its length.

Each rain gutter section 22 also includes (FIGS. 2 and 13) means defining a channel 76 extending along the length of the rain gutter section 22. Preferably, the channel 76 extends along the outer surface of the rear wall 34. While various suitable constructions for the channel defining means could be used, in the illustrated embodiment, the rear wall 34 includes (FIG. 12) an integral intermediate portion 86 that extends inwardly of the trough from the upper edge 38 of the main portion 40 of the rear wall 34 and that provides oppositely facing upper and lower surfaces 90, 94. For reasons discussed below, the intermediate 86 portion also extends inwardly at a slight downward angle. Also, the intermediate portion 86 is preferably resiliently deflectable.

The channel defining means also includes (FIGS. 12 and 13) a vertical portion 102 of the rear wall 34 extending upwardly from the innermost edge of the intermediate portion 86. The vertical portion 102 is integrally formed with the intermediate portion 86. The channel defining means also includes a rearwardly extending portion 114 of the rear wall 34 integrally formed with the vertical portion 102. The rearwardly extending portion 114, the vertical portion 102 and the intermediate portion 86 of the rear wall respectively form (FIG. 1) the respective upper side, outwardly facing side and lower side of the rearwardly opening channel 76.

Figures 3, 4, 5:
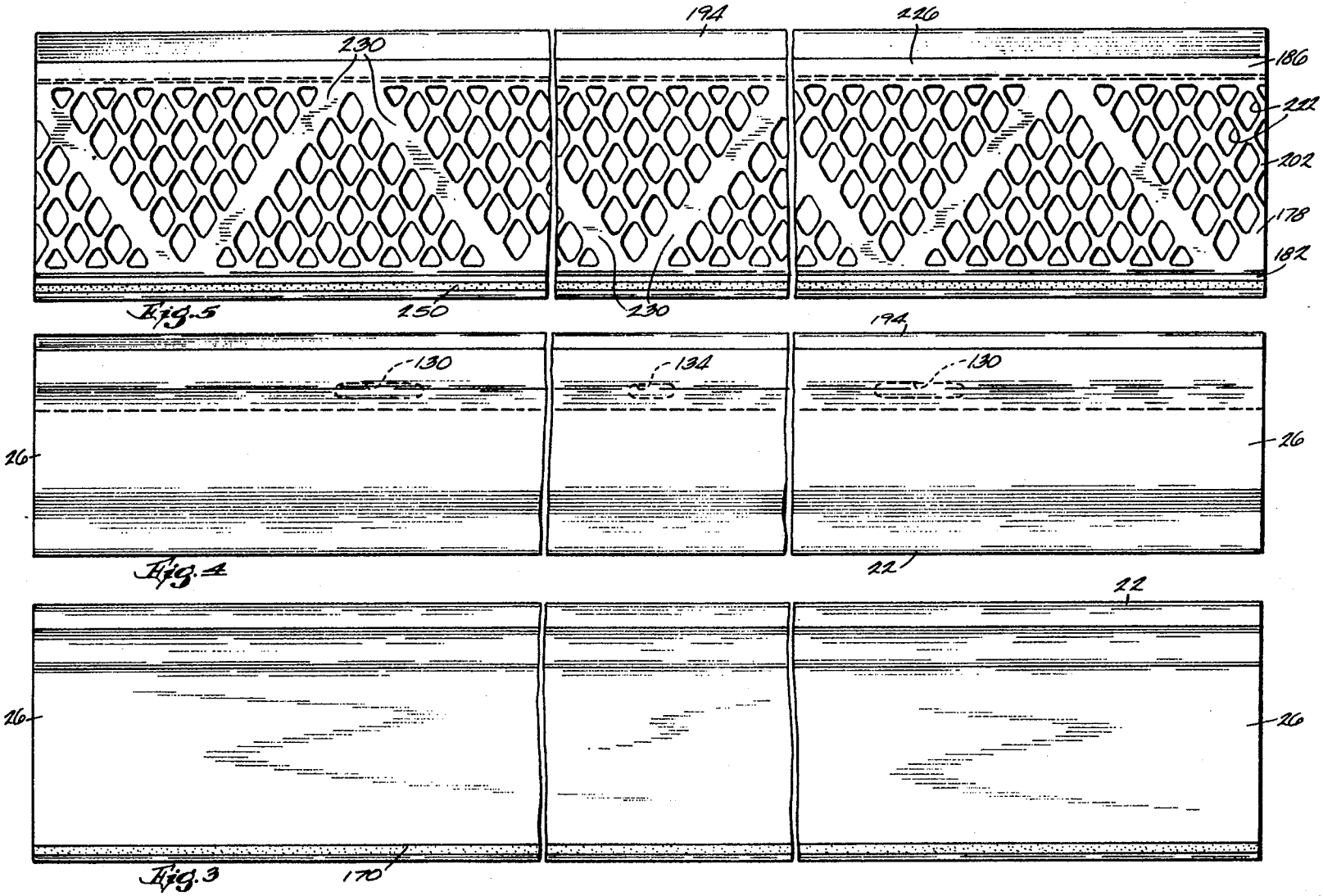
FIG. 3 is a bottom plan view of a rain gutter section.
FIG. 4 is a front elevational view of the rain gutter section shown in FIG. 3.
FIG. 5 is a top plan view of the rain gutter section shown in FIG. 3.

As shown in FIG. 4, and for reasons discussed below, each rain gutter section 22 also includes a plurality of slots 130 extending generally horizontally, or longitudinally of the rain gutter section 22, along portions of the vertical portion 102 of the rearwardly opening channel 76. The slots 130 are mutually, longitudinally aligned and are spaced apart uniformly along the length of the rain gutter section 22. Each rain gutter section 22 also includes a first grommet locating hole 134 that is equidistant from the opposite ends 26 of the rain gutter section 22. The first grommet locating hole 134 extends through the vertical portion 102 of the rearwardly opening channel 76 in a manner similar to the elongated slots 130. However, the grommet locating hole 134 differs from the elongated slots 130 in that it is not as long as the slots 130.

Figure 9:
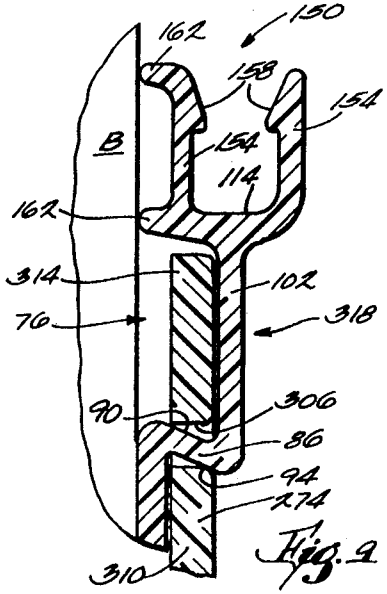
FIG. 9 is an enlarged cross-sectional view taken along line 9—9 in FIG. 8.

Also, for reasons discussed below, the rear wall 34 (FIGS. 2 and 9) includes means defining an upwardly opening channel 150 located above the rearwardly opening channel 76. More particularly, the upwardly opening channel 150 has a U-shaped cross-sectional configuration in a plane perpendicular to the length of the rain gutter section 22. The U-shape of the upwardly opening channel 150 is provided by a pair of spaced-apart clasp members 154 that extend upward from the rearwardly extending portion 114 of the rear wall 34. As best shown in FIG. 9, the respective distal ends of the clasp members 154 provide opposed detent portions 158. Also, the outermost clasp member 154 (i.e., the left clasp member 154 in FIG. 9) includes a pair of vertically spaced-apart set-off tabs 162 having respective ends that contact the side of the building.

Each rain gutter section 22 also includes (FIG. 2) a first integral or living hinge 170 that extends along substantially the entire length of the rain gutter section 22 for integrally and flexibly connecting the rear wall 34 and the trough portion 50. The first living hinge 170 is a thin-walled segment that extends between, and is integrally formed with, the lower edge 42 of the rear wall 34 and the rearward edge 62 of the trough portion 50.

Each rain gutter section 22 also includes (FIGS. 1 and 2) a connecting member or web or leaf guard 178 having a front edge 182 and a rearward edge 186, both of which extend substantially the entire length of the rain gutter section 22. The front edge 182 of the leaf guard 178 is flexibly and integrally connected to the front wall 58 in a manner described below for movement between open and closed positions. When in the closed position (FIG. 2), the leaf guard 178 extends between and connects the respective upper edges of the rear and front walls 34, 58. Also, as discussed below, the rearward edge 186 of the leaf guard 178 includes means engageable with the clasp members 154 for selectively holding the leaf guard 178 in the closed position.

Figure 2:
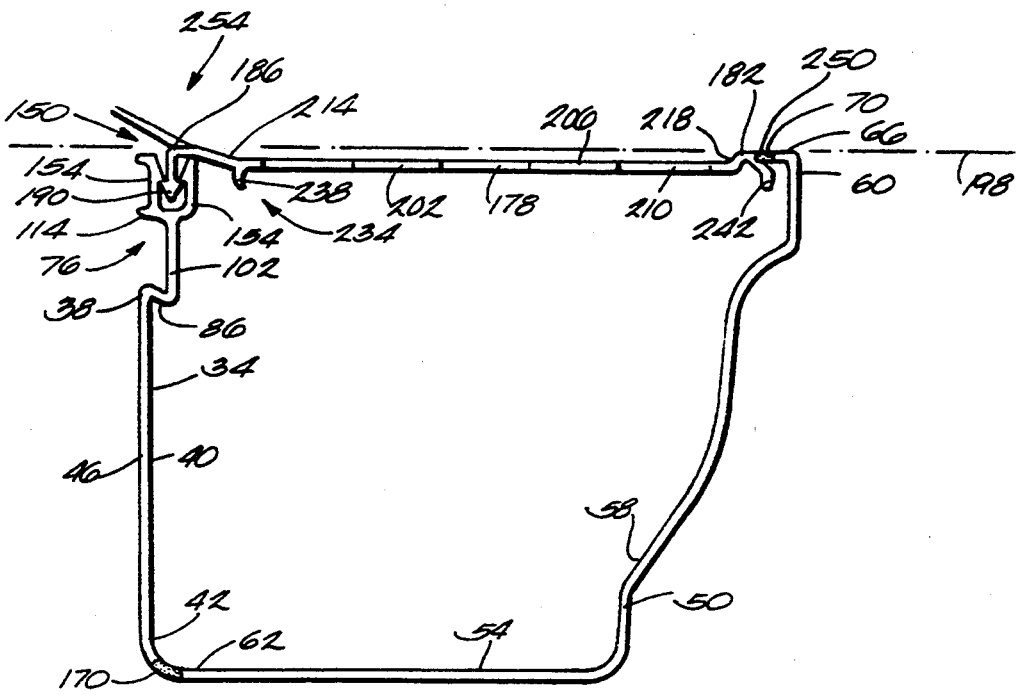
FIG. 2 is a cross-sectional view of a rain gutter section taken along line 2—2 in FIG. 1.
Figure 12:
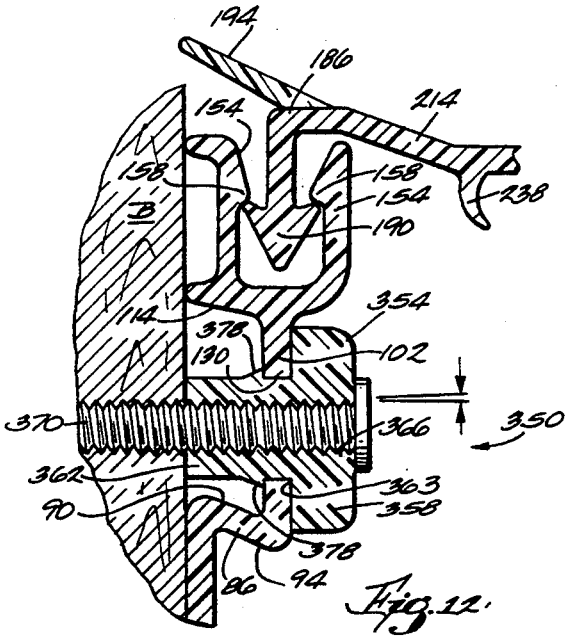
FIG. 12 is a cross-sectional view of a portion of a rain gutter section mounted on a wall.

As best shown in FIGS. 2 and 12, the rearward edge 186 of the leaf guard 178 has a barb-like member 190 extending therefrom. The barb 190 is rigidly and integrally formed with the leaf guard 178 and includes an end shaped like an arrowhead. For reasons discussed below, the barb 190 extends from the rearward edge 186 of the leaf guard 178 so as to be received by the upwardly opening channel 150 on the rear wall 34 and to selectively engage the clasp members 154 when the leaf guard 178 is closed.

The rearward edge 186 of the leaf guard 178 also supports (FIG. 1) a flexible drip edge 194 which prevents water from flowing behind the rain gutter section 22 and between the side of the building and the rear wall 34. The drip edge 194 is preferably integrally formed with the leaf guard 178, and, when the leaf guard 178 is closed, extends rearwardly upward from the rearward edge 186 of the leaf guard 178 into contact with the side of the building.

As best shown in FIG. 2, the front and rearward edges 182, 186 of the leaf guard 178 define a plane 198 which, when the leaf guard 178 is in the closed position, extends generally horizontally. The leaf guard 178 also includes a web 202 providing substantially flat upper and lower surfaces 206, 210 extending between the front edge 182 and the rear edge 186 of the leaf guard 178. The upper surface 206 of the web 202 is spaced from the plane 198 so that the upper surface 206 of the web 202 lies below the plane 198 when the leaf guard 178 is in its closed position.

The leaf guard 178 includes a transition portion or ramp 214 extending between the rearward edge 186 of the leaf guard 178 and the web 202. Water flowing onto the leaf guard 178 from the drip edge 194 flows down the ramp 214 onto the upper surface 206 of the web 202.

The leaf guard 178 also includes a ramp 218 extending between the front edge 182 of the leaf guard 178 and the web 202. The ramp 218 helps prevent water flowing onto the upper surface 206 of the web 202 from overflowing the front edge 182 of the leaf guard 178.

The web 202 (FIGS. 1 and 5) has therein a plurality of apertures or holes 222 which are sufficiently large to allow water to fall from the roof and into the rain gutter section 22, but which are sufficiently small to prevent leaves, twigs and other material from falling into the rain gutter and obstructing the flow of collected water. The holes 222 are preferably diamond-shaped. The holes 222 are arranged in a substantially uniform pattern that provides a solid strip 226 of material extending along the length of the rain gutter section 22 adjacent the rearward edge 186 of the leaf guard 178. Also, as best shown in FIG. 5, the web 202 includes a strengthening support web 230 extending the length of the leaf guard 178 in an uninterrupted zig-zag pattern. The support web 230 is integrally formed in the leaf guard 178 and, due to its uninterrupted length, itself interrupts the otherwise uniform pattern of the holes 222.

The lower surface 210 of the web 202 faces the bottom wall 54 when the leaf guard 178 is closed. The lower surface 210 of the web 202 supports (FIG. 2) water cutting means 234 for preventing water from traversing the lower surface 210 of the web 202 between the holes 222 and the rearward edge 186 of the leaf guard 178. While various suitable constructions can be used for such water cutting means 234, in the illustrated embodiment such means includes a tooth-like rib 238 extending from the lower surface 210 of the web 202 and extending longitudinally along substantially the entire length of the rain gutter section 22. The water cutting rib 238 is located rearward (i.e., to the left in FIG. 2) of the pattern of holes 222 in the web 202 and extends from the solid strip 226 of material extending along the rearward edge 186 of the web 202. The water cutting rib 238 is so located to prevent water flowing through the holes 222 from being drawn by surface tension rearwardly along the lower surface 210 of the web 202 and into the upwardly opening channel 150.

For reasons discussed below, the lower surface of the leaf guard 178 also includes (FIG. 2) a capturing tab 242 extending generally perpendicularly to the lower surface 210 of the web 202 adjacent the forward edge 182 of the leaf guard 178. When the leaf guard 178 is in the closed position, the capturing tab 242 is spaced rearwardly from the inner surface of the front wall 58 and extends downwardly toward the bottom wall 54.

Each rain gutter section 22 also includes a second living hinge 250 for integrally and flexibly connecting the front wall 58 and the leaf guard 178. The second living hinge 250 extends substantially the entire length of the rain gutter section 22 and joins the rearward edge 70 of the horizontal lip 66 and the front edge 182 of the leaf guard 178. As mentioned above, the flexible hinged connection between the leaf guard 178 and the trough portion 50 affords pivotal movement of the leaf guard 178 between the closed position (FIGS. 2 and 10) wherein the leaf guard 178 overlies the trough formed by the rain gutter section 22 and the open position (shown in phantom in FIG. 10) affording access to the trough.

The first and second living hinges 170, 250 integrally join the rear wall 34, the trough portion 50 and the leaf guard 178 as a single unit. The rain gutter sections 22 can therefore be made by extrusion of plastic, such as polyvinyl chloride (PVC), in a single operation. The hinges are preferably flexible PVC, while the remainder of the gutter sections 22 are rigid PVC. The slots 130 and 134 and holes 222 are punched out of the rear wall 34 and leaf guard 178 respectively after extrusion of the rain gutter sections 22. No additional parts, such as hinge pins or plates are necessary to form or assemble the rain gutter sections 22. The provision of a rain gutter section having hinged components allows the rain gutter section to be laid open into a relatively flat position, which facilitates the stacking of the rain gutter sections 22. As discussed below, the provision of a rain gutter section that can be laid open also facilitates the installation, assembly and cleaning of the rain gutter assembly 10.

Each rain gutter section 22 also includes interlocking means 254 to hold the rain gutter in a trough-like position. Preferably, the interlocking means 254 includes (FIGS. 12 and 13) the clasp members 154 on the rear wall 34 and the barb 190 extending from the rearward edge 186 of the leaf guard 178. As mentioned above, when the leaf guard 178 is closed, the clasp members 154 receive the barb 190 therebetween. The detent portions 158 and the barb 190 thus cooperate to selectively hold the leaf guard 178 in the closed position over the trough portion 50 and also to hold the rain gutter section 22 in a trough-like configuration. However, when access to the trough is desired, the clasp members 154 can be biased apart and the barb 190 retracted therefrom by lifting the leaf guard 178.

Figure 19:
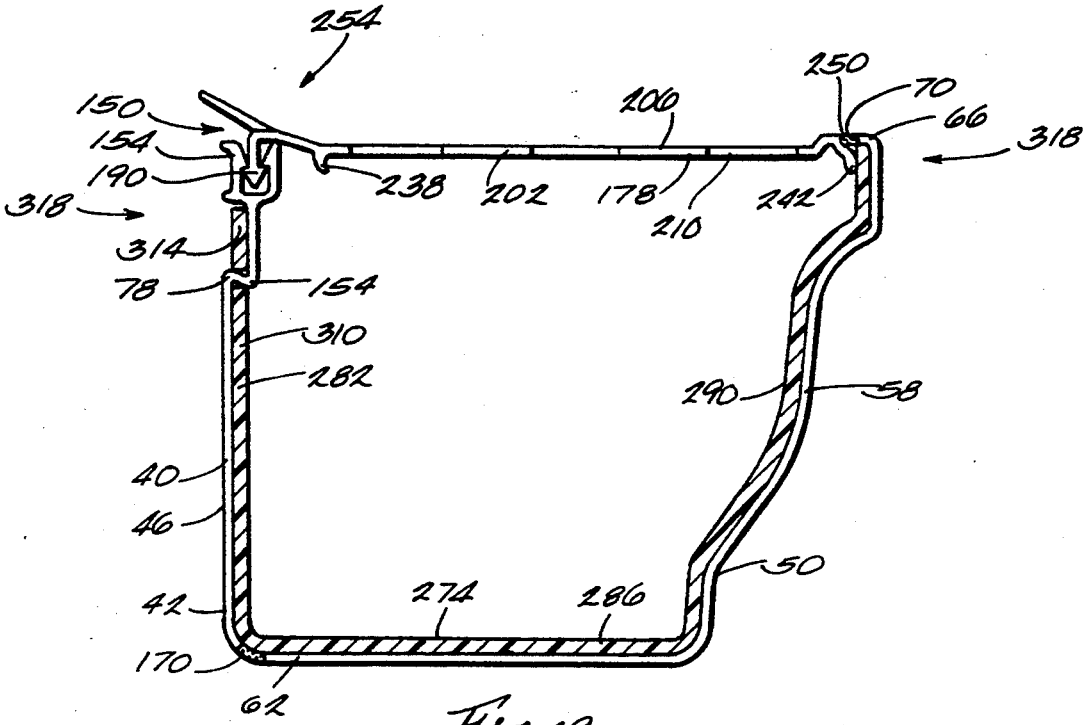
FIG. 19 is an end view of the rain gutter section and connector shown in FIG. 17 with the rain gutter section closed.
Figure 6:
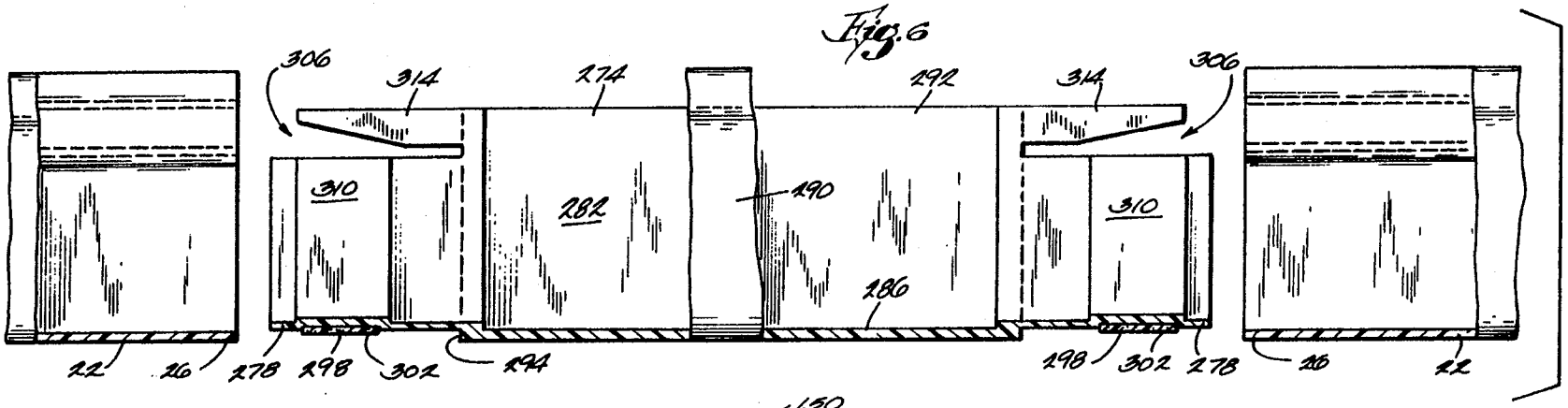
FIG. 6 is an exploded front elevational view in partial cross-section of a pair of rain gutter sections and a connector member.
Figure 7:
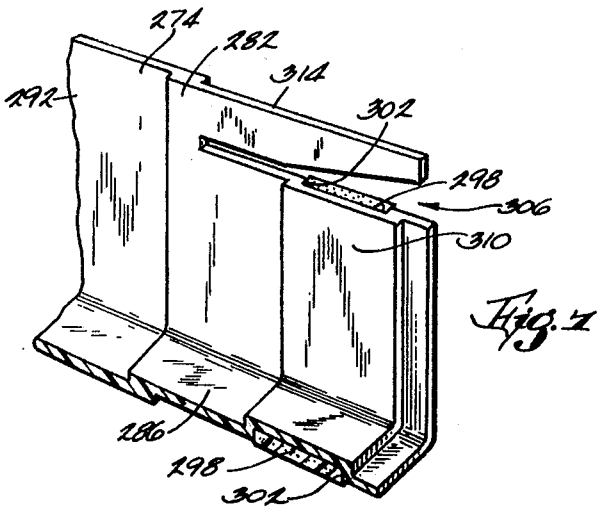
FIG. 7 is a perspective view in cross-section of a portion of a connector member.
Figure 8:
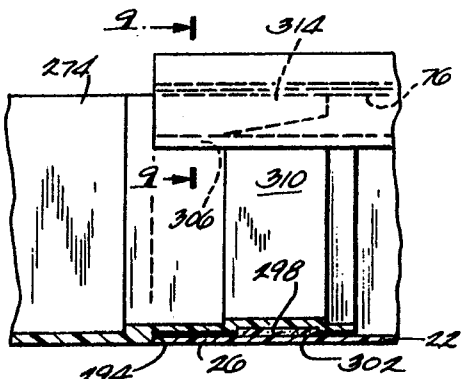
FIG. 8 is a cross-sectional view of a rain gutter section engaged with a connector member.

The rain gutter assembly 10 also includes (FIG. 1) connecting means 270 extending between each pair of mutually aligned, closely-spaced rain gutter sections 22 for joining the adjacent rain gutter sections 22. While various suitable constructions for the connecting means 270 can be used, in the illustrated embodiment, the connecting means 270 includes (FIGS. 1 and 6) a rigid connector member 274 having opposite end portions 278 engaged with the opposed ends 26 of the adjacent rain gutter sections 22. As best shown in FIGS. 7 and 19, the connector member 274 includes a rear wall 282, a bottom wall 286, and a front wall 290. The connector member 274 also includes an intermediate section 292 extending between the end portions 278 and providing (FIG. 1) an outer surface 294 that approximates the outer surfaces of the adjacent rain gutter sections 22. As shown in FIGS. 6–8, the end portions 278 of the connector member 274 have an external step 294 that is sized to allow the end portions 278 to nest with the rain gutter sections 22. When the connector member 274 is nested with adjacent rain gutter sections 22, portions of the front, bottom and rear walls 290, 286, 282 adjacent the opposite ends of the connector member 274 overlap respective portions of the front, bottom and rear walls 58, 54, 34 of the rain gutter sections 22. As a result, when the rain gutter sections 22 and the connector member 274 are nested (FIG. 8), the stepped end portions 278 of the connector member 274 abut the respective ends 26 of the rain gutter sections 22. Also, when the connector member 274 and rain gutter sections 22 are so nested, the outer surface 294 of the intermediate portion 292 of the connector member 274 is substantially flush with the outer surfaces of the adjacent rain gutter sections 22.

In order to provide a relatively water-tight, sealed joint between the rain gutter sections 22 and the connector member 274, the connecting means 270 also includes (FIGS. 6 and 7) a gasket 298 extending around the outer surface of each end portion 278 of the connector member 274. The gaskets 298 are located within channels 302 extending around the portions of the connector member 274 that, when the connector member 274 is nested with the gutter sections 22, are overlapped by the rain gutter sections 22. The gaskets 298 are thus (FIG. 8) positioned between the connector member 274 and rain gutter sections 22 to provide a water-tight joint. The connector member 274 is securely held in nested relation with the rain gutter sections 22 in a manner discussed below to assure that water channeled by the rain gutter sections 22 flows across the connector/rain gutter section joint without leaking.

The rear wall 282 of the connector member 274 has extending therein (FIG. 6) a pair of longitudinally extending slots 306. More particularly, the rear wall 282 of each end portion 278 of the connector member 274 includes a lower compression portion 310 and a bayonet portion 314 spaced above the compression portion 310. The bayonet portion 314 and the compression portion 310 define therebetween the slot 306. For reasons discussed below, the bayonet portion 314 tapers upwardly near the end of the connector member 274 such that the connector slot 306 flares outwardly. Inwardly of its tapered portion, the slot 306 has a relatively uniform height that approximates the thickness of the intermediate portion 86 of the rear wall 34.

The rain gutter 14 also comprises (FIG. 19) means 318 for securely joining the rain gutter section 22 with the connector member 274. While various suitable constructions for the securing means 318 can be used, in the illustrated embodiment of the rain gutter, the securing means 318 includes the capturing tab 242 located on the leaf guard 178. As mentioned above and as shown in FIG. 19, portions of the front walls 290, 58 of the connector member 274 and the rain gutter section 22 overlap. In response to movement of the leaf guard 178 from the open position to the closed position, the capturing tab 242 on the leaf guard 178 moves into engagement with the inner surface of the front wall 290 of connector member 274. When so engaged, the capturing tab 242 clamps the front wall 290 of the connector member 274 against the inner surface of the front wall 58 of the rain gutter section 22 to hold the connector member 274 securely against the inner surface 30 of the rain gutter section 22.

The securing means 318 also includes means for releasably engaging the connector member 274 and the rear wall 34 of the rain gutter section 22. While various suitable constructions can be used, in the illustrated embodiment, such means includes sliding engagement between the intermediate portion 86 of the rear wall 34 of the rain gutter section 22 and the slot 306 in the rear wall 282 of the connector member 274. More particularly, and as best shown in FIGS. 8 and 9, the connector member 274 can be slid into engagement with the gutter section 22 by aligning the bayonet portion 314 of the connector member 274 with the end of the rearwardly opening channel 76 and then pushing the connector onto the end 26 of the rain gutter section 22. Alternatively, the intermediate portion 86 of the rear wall 34 of the rain gutter section 22 can be aligned with the slot 306 in the connector member 274. The connector member 274 can then be slid longitudinally onto the end 26 of the rain gutter section 22. When so assembled, the slot 306 in the rear wall 282 of the connector member 274 moves into housing relation with the intermediate portion 86 and the bayonet portion 314 is housed by the rearwardly opening channel 76.

When so arranged, the intermediate portion 86 and the connector member slot 306 are releasably engaged by frictional contact between the upper surface 90 of the intermediate portion 86 and the bayonet portion 314, and between the lower surface 94 of the intermediate portion 86 and the compression portion 310 of the connector member 274. The frictional contact between the connector member 274 and the intermediate portion 86 results from making the height of the uniform portion of the slot 306 approximately the same as the thickness of the intermediate portion 86.

Due to the downwardly extending angle of the intermediate portion 86, the upper edge of the compression portion 310 of the connector member 274 is biased downwardly and rearwardly against the inner surface of the rear wall 34. When the rain gutter section 22 is engaged with the connector member 274 and is in the trough position, the intermediate portion 86 further tends to bias the rear wall 282 of the connector against the inner surface of the rear wall 34 to secure the connector member 274 in position relative to the rain gutter section 22.

Figure 13:
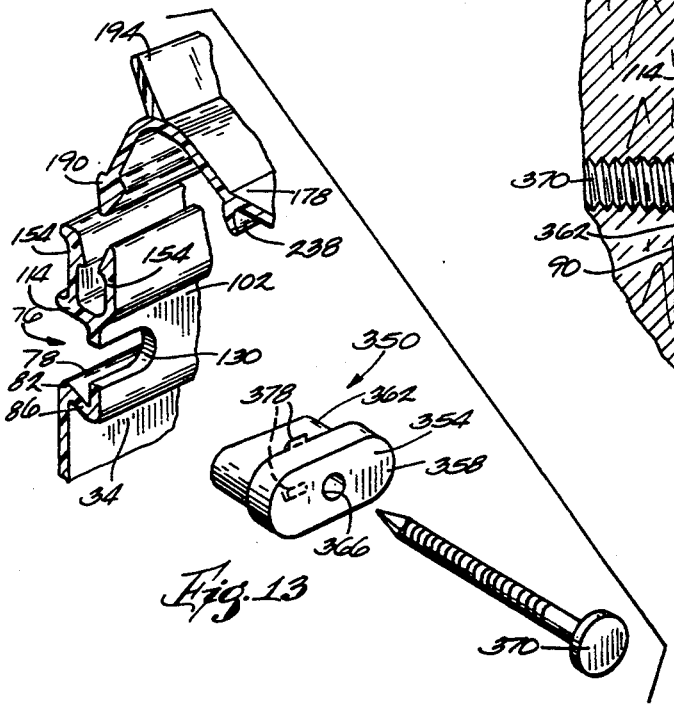
FIG. 13 is an exploded perspective view of the portion of the rain gutter shown in FIG. 12.

Referring now to FIGS. 12, 13, 15 and 16 the rain gutter assembly 10 also includes means 350 for supporting the rain gutter 14 on the side of the building. The means 350 for supporting the rain gutter 14 includes the above-described plurality of elongated slots 130 and the first grommet locating hole 134 in the rear wall 34 of the rain gutter sections 22. The means 350 also includes a plurality of grommets 354. As best shown in FIGS. 12 and 13, each grommet 354 includes a generally oblong head 358 and a shank 362 extending from the head 358. The head 358 includes (FIG. 12) an annular surface 363 surrounding the shank 362. For reasons discussed below, the shank 362 of each grommet 354 has a generally oblong outer surface that is sized to permit the shank 362 to be placed into a slot 130 or in a grommet locating hole 134. The length of the grommet 354 and the lengths of the slots 130 and the holes 134 are such that a grommet 354 can slide longitudinally within a slot 130 but cannot slide within a hole 134. However, the oblong configuration of the shank 362 and the height of the slots 130 and hole 134 prevents rotation of the grommet 354 relative to the rain gutter section 22. Each grommet 354 also has extending therethrough a bore 366 that is adapted to house a fastener 370 for fixing the grommet 354 to the vertical wall of a building. The drawings illustrate the use of a nail screw extending through the bore 366 in the grommet 354. However, other fasteners can also be used.

The means 350 for supporting the rain gutter 14 also includes interengaging means on the rain gutter section 22 and on the grommet 354 for selectively securing the grommet 354 to the rear wall 34 of the rain gutter section 22 prior to securing the rain gutter section 22 to the vertical wall. While various suitable constructions can be used, in the illustrated embodiment, such means includes (FIG. 12) a pair of nibs 378 extending radially outwardly from the shank 362 of the grommet 354. The nibs 378 are located on the opposite elongated sides of the shank 362 and are spaced away from the annular surface 363 of the head 358. As shown in FIG. 12, when the grommet 354 is placed into a slot 130, the shank 362 extends into the channel 76, and the nibs 378 and the annular surface 363 of the head 358 capture the vertical portion 102 of the rear wall 34. The distance between the nibs 378 and the surface 363 is such that the wall portion 102 can slide therebetween. When so engaged with the rear wall 34, the grommet 354 cannot freely fall from the slot 130. The nibs 378 similarly engage the rear wall 34 if the grommet 354 is placed in a grommet locating hole 134.

Thus, the grommet securing means prevents free rotation of the grommet 354 relative to the rain gutter section 22 and prevents the grommet 354 from freely falling out of housed relation with the slots 130 and first grommet locating holes 134. However, as mentioned above, a grommet 354 placed into housed relation with a slot 130 can be moved longitudinally of the rain gutter 22 along the length of the slot 130. A grommet 354 positioned in a locating hole 134 is centered between the ends 26 of the rain gutter section 22 and is not moveable relative thereto.

The means for supporting the gutter 14 also includes (FIG. 12) means for selectively holding the fastener 370 in position relative to the rain gutter section 22 prior to securing the rain gutter section 22 to the vertical wall. While various suitable constructions for the fastener holding means can be used, in the illustrated embodiment, such means includes a draft angle in the bore 366 extending through the grommet 354. The draft angle in the fastener bore 366 tapers from the head 358 of the grommet 354 to the end of the shank 362 (right to left in FIG. 12) so that a properly-sized fastener extending through the bore 366 engages the grommet 354 and is held in position relative thereto.

The provision of means on the rain gutter sections 22 and the grommet 354 for holding the grommet 354 relative to the rain gutter section 22 and the provision of means for holding the fastener relative to the grommet 354 allows the installer of the rain gutter to place several fasteners 370 into engagement with respective grommets 354 and to temporarily secure the grommets 354 in the slots 130 prior to mounting the rain gutter 14 on a vertical wall. The advantage provided by such pre-installation assembly of the fasteners 370, grommets 354 and rain gutter sections 22 is explained fully below.

The rain gutter assembly 10 also includes (FIGS. 1 and 10) the above-mentioned downspout 18 for collecting water channeled by the rain gutter 14. The illustrated downspout 18 includes (FIG. 10) a drop outlet member 390, downspout sections 394, elbows 398, and a downspout connector 402. While not illustrated in their entirety, the downspout sections 394 are generally elongated members having a substantially uniform outer surface.

The drop outlet member 390 is substantially identical to a connector member 274 and is similarly joined to adjacent rain gutter sections 22. The drop outlet member 390 also includes (FIG. 10) an outlet 406 formed in the bottom wall of the trough portion of the drop outlet member 390. The outlet 406 is surrounded by a downwardly projecting outlet wall 410 extending around the periphery of the outlet 406. The outlet wall 410 includes an outer surface 414 with a step 416 such that the lower portion of the outlet wall 410 can be moved into telescopic housed relation with an end of a downspout section 394 (this arrangement is not shown in the drawings). When so housed, the step 416 in the outlet wall 410 abuts the end of the downspout section 394. Also, for reasons discussed below, the drop outlet member 390 includes a resiliently deflectable hanger member or hook 418 located adjacent the outlet 406 and spaced rearwardly from the outlet wall 410.

Figures 10, 11:
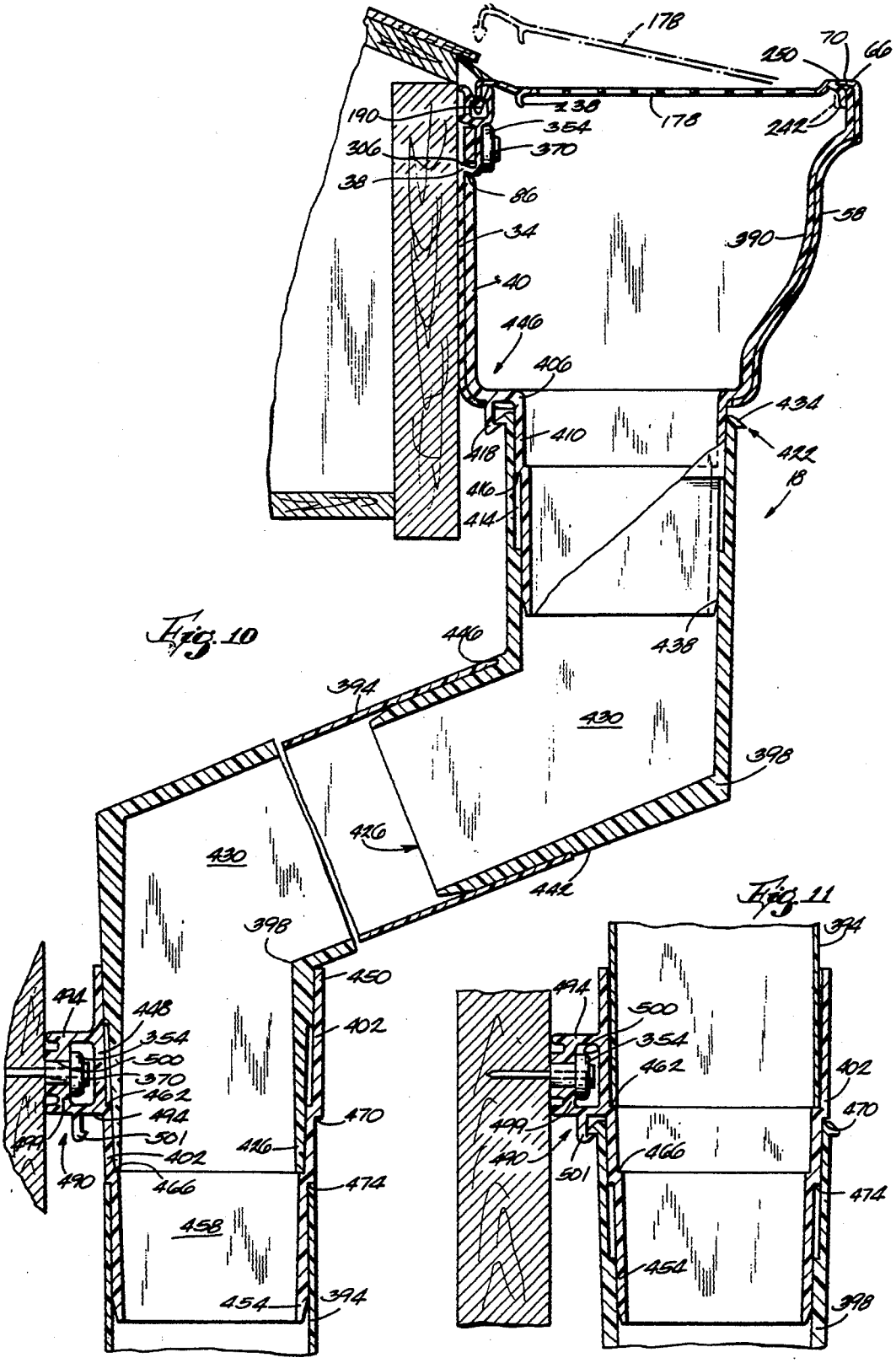
FIG. 10 is a cross-sectional view taken along line 10—10 in FIG. 1 showing the rain gutter assembly mounted on a building.
FIG. 11 is a cross-sectional view of an alternative arrangement of the downspout shown in FIG. 10.

The downspout elbows 398 have (FIG. 10) opposite upper and lower ends 422, 426 and a passage 430 communicating between the opposite ends 422, 426. The upper end 422 of the elbow 398 includes an outwardly turned flange 434 extending around the periphery of the upper end 422. The elbow 398 also includes, adjacent the upper end 422, a stepped inner surface 438. The stepped inner surface 438 allows the elbow 398 to be moved into telescopic housing relationship with the lower end of the outlet wall 410 (as shown in FIG. 10) or to be moved into telescopic housing relation with a downspout section 394 (not shown). When in housing relationship with the outlet wall 410, the passage 430 in the elbow 398 communicates with the trough defined by the rain gutter 14 through the outlet 406 in the drop outlet member 390.

The downspout 18 also includes means 446 for securing the elbow 398 to the drop outlet member 390. While various suitable support means can be successfully used, in the illustrated embodiment, such means includes engagement between the hook 418 on the bottom of the drop outlet member 390 and the outwardly turned flange 434 on the upper end of elbow 398. As shown in FIG. 10, the elbow 398 can be moved into housing relation with the outlet wall 410 and into a locked position wherein the upper end 422 of the elbow 398 is adjacent the bottom wall of the drop outlet member 390 and the lower surface of the outwardly turned flange 434 is engaged by the distal end of the hook 418.

As shown in FIG. 10, the elbow 398 includes, adjacent the lower end 426, an outer surface 442 having a step 446 that allows the lower end 426 of the elbow 398 to be moved into telescopic housed relation with the end of a downspout section 394. When so arranged, the step 446 in the lower end of the elbow 398 abuts the end of the downspout section 394.

The downspout connector 402 includes a rear wall 448, opposite upper and lower ends 450, 454 and an outer surface that is substantially similar to that of a downspout section 394. The downspout connector 402 also has a passage 458 extending between the opposite ends 450, 454 for conducting water. The downspout connector 402 includes a "double step" interior surface having upper and lower steps 462 and 466. As shown in FIG. 10, the portion of the downspout connector 402 between the steps 462 and 466 is sized to telescopically house the lower end of an elbow 398 so that the second, lower step 466 abuts the lower end 426 of the elbow 398. As shown in FIG. 11, which illustrates an alternative arrangement, the portion of the downspout connector 402 above the uppermost step 462 is sized to telescopically house a downspout section 394 so that the first step 462 abuts the lower end of the downspout section 394. Thus, either an elbow 398 or a downspout section 394 can rest on the downspout connector 402.

The downspout connector 402 also has a stepped exterior surface having upper and lower steps 470 and 474. As shown in FIG. 10, the portion of the downspout connector 402 below the step 474 can be moved into telescopically housed relation with a downspout section 394 in a manner similar to the engagement between a downspout section 394 with the lower end of an elbow 398. Alternatively, and as shown in FIG. 11, the portion of the downspout connector 402 between the steps 470 and 474 can be moved into housed relation with the upper end of an elbow 398.

Figure 14:
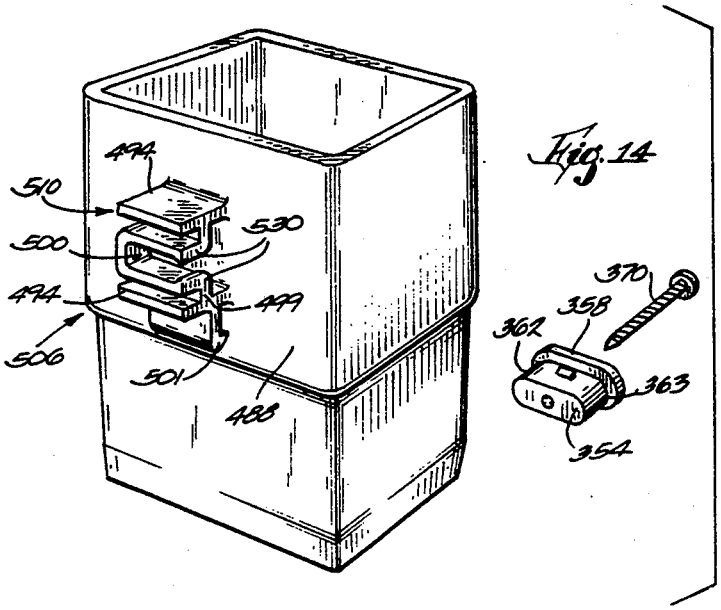
FIG. 14 is an exploded perspective view of a portion of a downspout.

The downspout connector 402 also includes (FIGS. 10, 11 and 14) an integral bracket portion 490 on the rear wall 448 of the downspout connector 402. The bracket portion 490 includes a pair of vertically spaced-apart bracket plates 494 that extend generally horizontally from the rear wall 448 of the downspout connector 402. A vertical wall 499 extends between the plates 494, is spaced from the rear wall 448, and has therein a horizontal, blind slot 500 extending from only one side of the wall 499. The downspout connector 402 also includes a hanger member or hook 501 that extends downwardly from the lower bracket plate 494 and that is spaced from the rear wall 448 of the downspout connector 402. As shown in FIG. 11, the hook 501 on the bracket 490 is arranged similarly to the hook 418 on the drop outlet member 390 to engage an elbow 398 in a similar manner. The downspout connector 402 thus provides means for supporting an elbow 398 hanging below the downspout connector 402.

The rain gutter assembly 10 also includes mounting means for supporting the downspout 18 on the building. While various suitable downspout mounting means can be successfully used, in the illustrated embodiment, the downspout mounting means includes a projection extending from the building. Preferably, the projection is a grommet 354 identical to that used to mount the rain gutter to the building. The grommet 354 is fastened to the vertical wall of the building by a fastener 370.

The downspout mounting means also includes (FIG. 14) means 510 on the downspout for selectively engaging the grommet 354. More particularly, such means 510 is located on the downspout connector 402 and includes the slot 500. The slot 500 is sized to allow the shank 362 of a grommet 354 to slide into the slot 500. As shown in FIG. 10, the wall 499 is sufficiently spaced away from the rear wall 448 of the downspout connector 402 to allow the head 358 of a grommet 354 to be slid into the slot 500 and into housed relation between the rear wall 448 and the wall 499. The blind end of the slot 500 prevents the grommet 354 from sliding out of the slot 500 in the direction in which the grommet 354 enters the open end of the slot 500. Detents 530 (FIG. 14) on the wall 499 adjacent the open end of the slot 500 allow the grommet shank 362 to be forcibly passed therebetween but sufficiently engage the shank 362 to prevent the grommet 354 from freely sliding out of housed relation with the bracket 490.

Preferably, and as best shown ill FIGS. 1, 10 and 11, the components of the downspout 18 are configured such that a downspout component located above a lower, adjacent downspout component has a lower end housed within the upper end of the adjacent component so that water collected by the downspout 18 will flow into the passage of the lower component without leaking water through joints between the adjacent downspout components. In addition, the stepped inner and outer surfaces of the downspout components allow the downspout components to be assembled and to have substantially flush outer surfaces.

Figure 16:
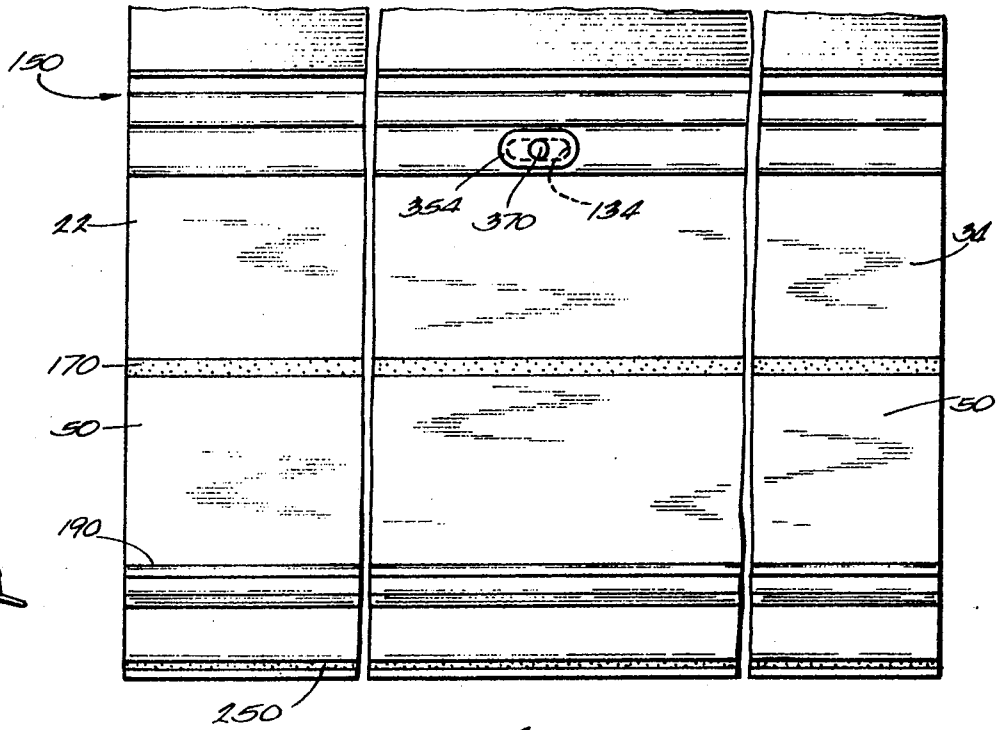
FIG. 16 is a front elevational view of the rain gutter section shown in FIG. 15.
Figure 15:
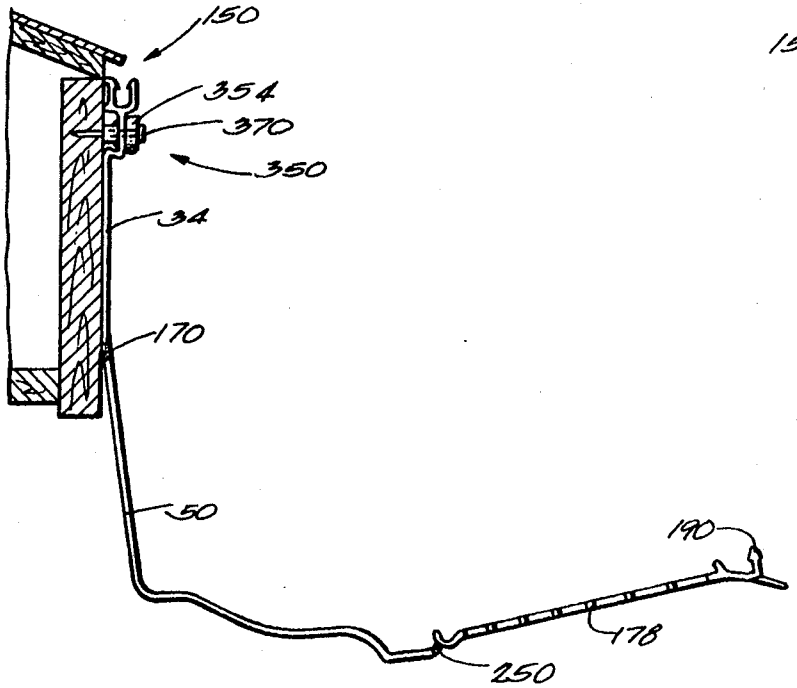
FIG. 15 is an end view of a rain gutter section that is mounted on a building and that is between a laid-open position and a trough position.
Figure 16:
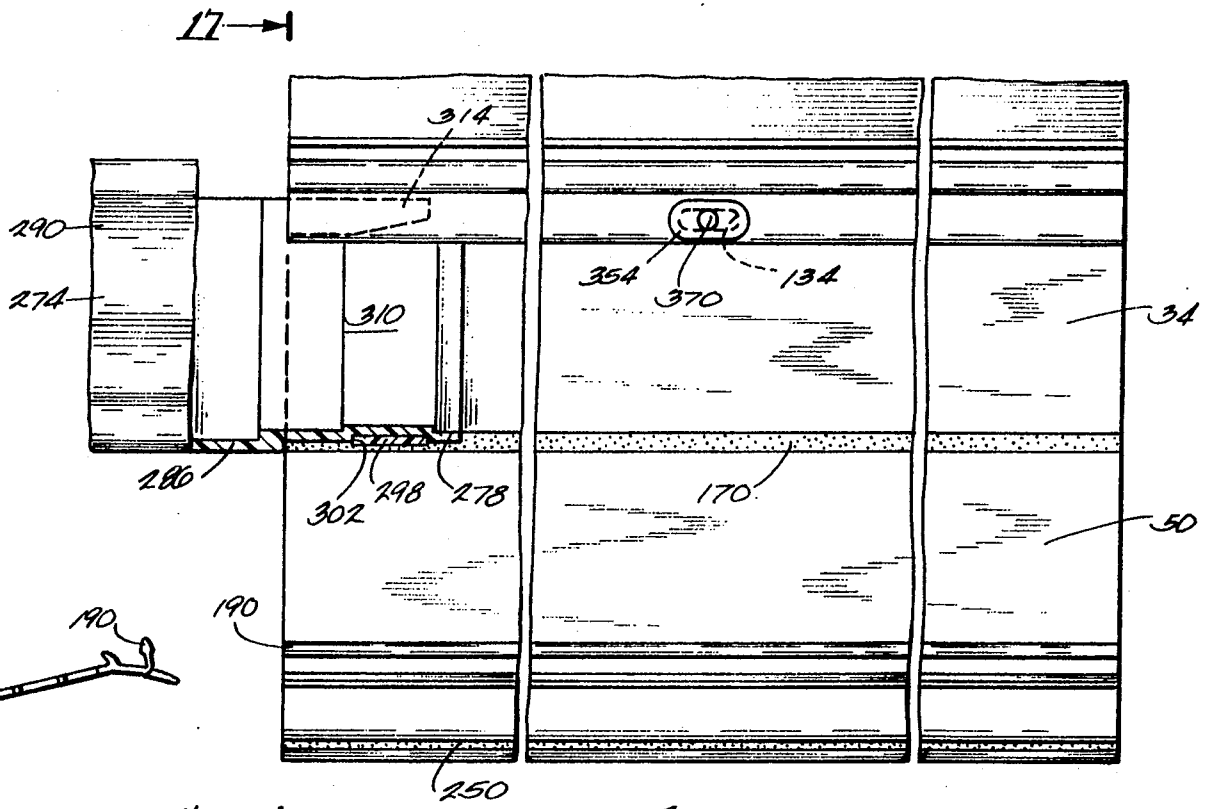

Installation of the rain gutter assembly 10 is simplified by the relatively light weight of the rain gutter sections 22 and the relatively few number of parts. The rain gutter sections 22, the grommets 354 and the fasteners 370 can be pre-assembled on the ground. Then, as shown in FIGS. 15 and 16, the rain gutter sections 22 can be hung in a laid-open position on the building by positioning the rear wall 34 where desired and fastening the rain gutter sections 22 and grommets 354 to the side of the building. Once hung on the building, a rain gutter section 22 can be folded into the trough-like position shown in FIG. 1 and held in position by interlocking the clasp members 154 with the barb 190 on the leaf guard 178.

More specifically, in order to assemble the rain gutter assembly 10, first and second rain gutter sections 22 are laid open in an unfolded position. The fasteners 370 for fixing the grommets 354 and rain gutter sections 22 to the vertical wall are assembled with the grommets 354. The grommets 354 and fasteners 370 housed thereby are then temporarily secured to the rain gutter sections 22 by placing a grommet 354 and fastener 370 in each first grommet locating hole 134 and in each elongated slot 130 in the first and second rain gutter sections 22.

After such pre-installation assembly, the first rain gutter section 22 is then (FIGS. 15 and 16) mounted to the side of a building by placing the rear wall 34 of the rain gutter section 22 against the wall and permanently fixing the fastener located in the first grommet locating hole 134 to the building. Because the first grommet locating hole 134 is centrally located between the ends of the rain gutter section 22, and because the rain gutter section 22 is relatively light, the rain gutter section 22 is adequately supported in a relatively balanced position by the single fastener in the first grommet locating hole 134. Because the grommet 354 cannot slide in the hole 134, the gutter section cannot move longitudinally relative to the building. Once the first fastener is fixed to the building, the remainder of the grommets 354 are centered in the elongated slots 130. The fasteners 370 in the centered grommets are then permanently fixed to the building. The lengths of the grommet shanks 362 are such that the rear wall 34 of the gutter section 22 can slide longitudinally relative to the grommets 354 in the slots 130.

Because the fasteners 370 are hammered into or otherwise secured to the wall when the rain gutter section 22 is laid open or unfolded, it is relatively easy to gain access to the fasteners 370 with a hammer or other tool.

Figure 17:
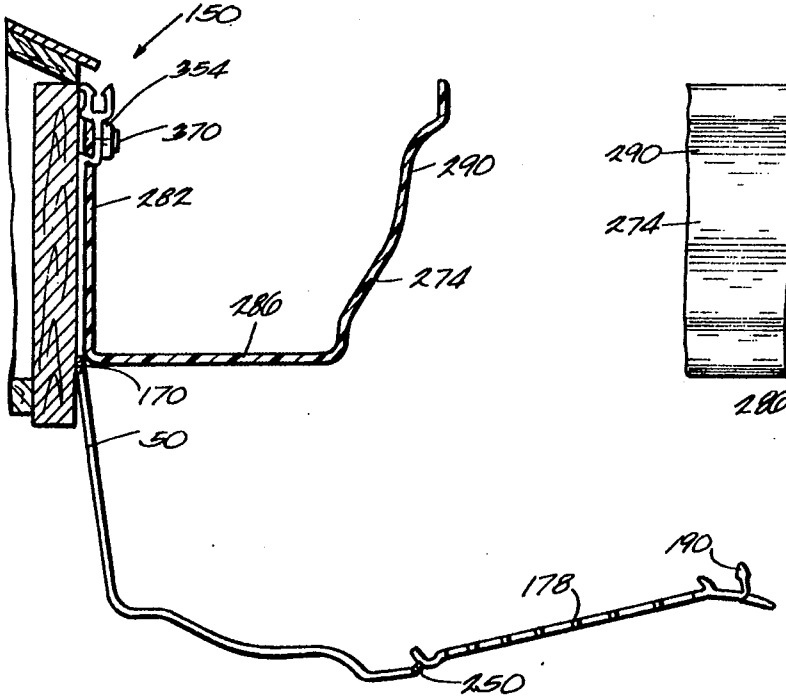
FIG. 17 is a view similar to FIG. 15 taken along line 17—17 in FIG. 18.

As shown in FIGS. 17 and 18, once the rear wall 34 of the first rain gutter section 22 is mounted on the wall, a connector member 274 or drop outlet member 390 is moved into engagement with one end of the first rain gutter section 22. When the connector member 274 or drop outlet member 390 is connected to the first rain gutter section 22, the first rain gutter section 22 supports the connector member 274: or drop outlet member 390.

After the connector member 274 or drop outlet member 390 is connected to the first rain gutter section 22, the first rain gutter section 22 (FIG. 19) is folded into a trough position by engaging the barb 190 on the leaf guard 178 with the clasp members 154 supported by the rear wall 34 of the rain gutter section 22. When so folded, the first rain gutter section 22 is permanently secured to the building. Also, folding of the gutter section 22 compresses the gasket 298 between the gutter section and the connector 274. The second rain gutter section 22 is then placed against the wall and an end of the second rain gutter section 22 is connected with the free end of the connector member 74 or drop outlet member 390 supported by the first rain gutter section 22. The second rain gutter section 22 is then permanently mounted on the wall by securing the fastener 370 in the first grommet locating hole 134 and then by following the other steps used to mount the first rain gutter section 22.

Alternatively, the rain gutter assembly 10 can be installed by placing the rear wall 34 of the second rain gutter section 22 in a laid-open position against the wall and connecting the second rain gutter section 22 with the connector member 274 or drop outlet member 390 prior to folding the first rain gutter section 22 into the trough position. The rear wall 34 of the laid-open second rain gutter section 22 is then permanently secured to the wall. After the rear walls of the laid-open first and second rain gutter sections 22 are fixed to the building and either a connector member 274 or drop outlet member 390 is supported therebetween, the first and second rain gutter sections 22 can be folded closed into troughs.

Additional rain gutter sections 22 are added to the gutter assembly 10 in a similar manner.

Once a drop outlet member 390 is assembled in the rain gutter 14, a downspout 18 can then be assembled and mounted on the wall. First, depending upon the configuration of the building, either an elbow 398 or downspout section 394 is placed into housing relationship with the outlet wall 410 on the drop outlet member 390. In the case of an elbow 398, the elbow 398 is snapped into engagement with the hook 418 on the drop outlet member 390. Once so engaged, the drop outlet member 390 supports the elbow 398. In the case of a downspout section 394, the downspout section 394 is held in housing relation with outlet wall 410 until a downspout connector 402 is mounted on the wall to support the downspout section 394.

A downspout connector 402 is then moved into housing relation with the lower end of either an elbow 398 or downspout section 394 located above the downspout connector 402. The downspout connector 402 is then mounted on the wall by first fastening a grommet 354 to the wall in the desired location to support the downspout connector 402. The downspout connector 402 is then slid horizontally into engagement with the grommet 354 as described above.

The gutter sections 22 can be unfolded in order to facilitate cleaning of the gutter assembly 10. The elongated slots 130 allow movement of the gutter sections 22 relative to the grommets 354 and thus allow for expansion and contraction of the gutters sections 22.

Various other features of the invention are set forth in the following claims:

We claim:

1. A rain gutter assembly adapted to be mounted on a building for collecting water, said assembly comprising a rain gutter adapted to contain water, means including a first grommet and a first fastener in said grommet for securing said rain gutter to the building, a downspout for draining water from said rain gutter, and means for supporting said downspout on the building, said means for supporting said downspout including a second fastener having a longitudinal axis, and a second grommet which is substantially identical to said first grommet and which is adapted to hold said second fastener for securing said second grommet to the building, and mounting means for mounting said downspout on said second grommet, said mounting means including means on said downspout for slidingly engaging said second grommet such that said downspout is slid into engagement with said second grommet in a direction transverse to said longitudinal axis of said second fastener.

2. A rain gutter assembly as set forth in claim 1 wherein said downspout includes a slot, and wherein said slot receives a portion of said second grommet.

3. A rain gutter assembly as set forth in claim 1 wherein said downspout is slid horizontally into engagement with said second grommet when said second grommet is secured to the building.

4. A rain gutter assembly adapted to be mounted on a building, said rain gutter assembly comprising a rain gutter adapted to contain water, a downspout for draining water from said rain gutter, said downspout having a rear wall, a projection adapted to be mounted on and extend from the building, and means for supporting said downspout, said means including means on said downspout for horizontally slidingly engaging said projection, said means for engaging said projection being an integral part of said rear wall, and wherein said means for engaging said projection includes an integral bracket portion on said rear wall, said bracket portion including a pair of vertically spaced-apart bracket plates that extend generally horizontally from said rear wall, and a vertical wall which extends between said plates, which is spaced from said rear wall, and which has therein a horizontal, blind slot for receiving said projection.

5. A rain gutter assembly adapted to be mounted on a building wall, said rain gutter assembly comprising a rain gutter including a wall having therein an aperture, a fastener for securing said rain gutter wall to the building wall, a grommet housing said fastener and having a portion extending into said aperture in said rain gutter wall, and means for selectively holding said fastener in position relative to said rain gutter prior to securing said rain gutter to the building wall, said holding means including means for holding said fastener in position relative to said grommet, and interengaging means on said rain gutter and on said grommet for selectively securing said portion of said grommet in said aperture in said rain gutter wall so as to secure said grommet to said gutter wall prior to securing said rain gutter to the building wall, wherein said interengaging means includes means for preventing rotation of said grommet relative to said gutter wall, said means for preventing rotation including said portion of said grommet having an oblong configuration.

6. A rain gutter assembly comprising an elongated rain gutter having a longitudinal axis and including an end and a generally vertical rear wall, said rear wall having an inner surface partially defining a water-carrying trough and having an outer surface defining a channel extending longitudinally of said rain gutter, said rear wall having a Z-shaped portion partially defining said channel, said channel being inset in said outer surface of said rear wall, and said assembly also comprising a connecting member engaged with said end of said rain gutter, said connecting member including a bayonet portion received in said channel, said connecting member also including a wall portion spaced beneath said bayonet portion so as to define a slot between said wall portion and said bayonet portion, said bayonet portion and said wall portion being substantially vertically coplanar, and said bayonet portion abutting said outer surface of said rear wall and said wall portion abutting said inner surface of said rear wall.

7. A rain gutter assembly as set forth in claim 6 wherein said Z-shaped portion of said rear wall includes an intermediate portion extending downwardly and inwardly between and in frictional contact with said bayonet and wall portions of said connecting member.

8. A rain gutter assembly as set forth in claim 7 wherein said intermediate portion biases said wall portion of said connecting member against said rear wall of said gutter.

9. A rain gutter assembly as set forth in claim 6 and further including a second elongated rain gutter including an end and means defining a channel extending longitudinally of said second rain gutter, and wherein said connecting member extends between and connects said ends of said rain gutters, said connecting member including a second bayonet portion received in said channel of said second rain gutter.

10. A one-piece, extruded rain gutter comprising a rear wall having a length, a trough portion having a length, a connecting member having a length, means including a first integral hinge extending substantially the entire length of said rear wall and said trough portion for flexibly and integrally connecting said rear wall and said trough portion, and means including a second integral hinge extending substantially the entire length of said trough portion and said connecting member for flexibly and integrally connecting said trough portion and said connecting member, said hinges allowing said gutter to be laid open in a substantially flat position so as to be easily stacked for storage and handling.

11. An extruded rain gutter comprising a rear wall including an upper edge, a front wall including a vertical portion having an upper edge and a horizontal portion extending rearwardly from said upper edge of said vertical portion and including a rearward edge having a length, a connecting web having a length, a forward edge, and a rearward edge, an integral hinge extending substantially the entire length of said connecting web and substantially the entire length of said horizontal portion for flexibly and integrally connecting said forward edge of said connecting web and said rearward edge of said horizontal portion, and means for selectively securing said rearward edge of said connecting web to said upper edge of said rear wall.

12. A rain gutter as set forth in claim 11 wherein said forward and rearward edges of said web define therebetween a first plane, and wherein said web has a substantially flat upper surface that extends between said opposite edges and that is vertically spaced below said plane.

13. A rain gutter as set forth in claim 11 wherein said connecting web is a leaf guard having therein holes allowing water to flow into said gutter, and wherein said leaf guard includes a lower surface, and means for preventing water from traversing said lower surface.

14. A rain gutter as set forth in claim 13 wherein said means for preventing water from traversing said lower surface includes a projection extending downwardly from said lower surface of said leaf guard and extending along said length of said leaf guard.

15. A rain gutter assembly comprising an elongated rain gutter having an end, a front wall having an upper edge, and a rear wall having an upper edge, a connecting web, means for pivotally connecting said connecting web to said upper edge of one of said front and rear walls of said gutter and for affording movement of said connecting web into a closed position wherein said connecting web extends between said upper edge of said rear wall and said upper edge of said front wall, a member connected to said end of said rain gutter and having a portion partially overlapping said front wall, and means on said connecting web for clamping said overlapping portion of said member against said front wall in response to movement of said connecting web into said closed position.

16. A rain gutter assembly as set forth in claim 15 wherein said connecting web is pivotally connected to said upper edge of said front wall.

17. A rain gutter assembly as set forth in claim 15 wherein said clamping means includes a projection extending from said connecting web.

18. A rain gutter assembly as set forth in claim 17 wherein said front wall has an inner surface, and wherein said projection clamps said member against said inner surface when said web is in said closed position.

19. An extruded rain gutter comprising a rear wall including an upper edge, a forward wall including an upper edge, and a one-piece, elongated leaf guard connecting said upper edges of said rear and forward walls, said leaf guard including a plurality of apertures arranged in a substantially uniform pattern to provide a normal spacing between apertures, and a strengthening support web extending the length of said leaf guard in an uninterrupted zig-zag pattern, said support web interrupting said uniform pattern such that the spacing between apertures separated by said support web is greater than said normal spacing.

20. A rain gutter as set forth in claim 19 wherein said upper edge of said rear wall and said upper edge of said forward wall define therebetween a first plane, and wherein said leaf guard has a substantially flat upper surface defining a second plane that lies below said first plane between said rear wall and said forward wall.

21. A rain gutter as set forth in claim 19 wherein said leaf guard includes a lower surface, and means for preventing water from traversing said lower surface.

22. A rain gutter as set forth in claim 21 wherein said means for preventing water from traversing said lower surface includes a projection extending downwardly from said lower surface of said leaf guard and extending along said length of said leaf guard.

23. An extruded rain gutter comprising a rear wall, a front wall, a leaf guard connecting said rear wall and said front walls said leaf guard having a length and a lower surface and having therein holes allowing water to flow into said gutter, and means for preventing water from traversing said lower surface, said means including a projection extending downwardly from said lower surface of said leaf guard and extending along said length of said leaf guard.

24. A rain gutter as set forth in claim 23 wherein said projection is located adjacent said rear wall.

25. A rain gutter assembly comprising an elongated rain gutter having a longitudinal axis and including an end and a generally vertical wall, said wall having an inner surface partially defining a water-carrying trough and having an outer surface defining a channel extending longitudinally of said rain gutter, and said assembly also comprising a connecting member engaged with said end of said rain gutter, said connecting member including a generally vertical wall and a bayonet portion which is an extension of said vertical wall of said connecting member, which is received in said channel, and which has a horizontally extending thickness, a height substantially greater than said thickness, and a length substantially greater than said height, said length extending in the direction of said axis, wherein said channel is defined by a wall having oppositely facing surfaces, wherein said connecting member includes a compression portion spaced from said bayonet portion to define therebetween a slot, and wherein said wall is received in said slot and said oppositely facing surfaces respectively engage said bayonet portion and said compression portion.

26. A rain gutter assembly as set forth in claim 25 and further including a second elongated rain gutter including an end and means defining a channel extending longitudinally of said second rain gutter, and wherein said connecting member extends between and connects said ends of said rain gutters, said connecting member including a second bayonet portion received in said channel of said second rain gutter.

27. A rain gutter assembly as set forth in claim 25 wherein said rain gutter includes spaced front and rear walls having respective inner and outer surfaces, and wherein said vertical wall of said rain gutter is said rear wall.

28. A rain gutter assembly as set forth in claim 27 wherein said channel is inset in said outer surface of said rear wall.

29. A rain gutter assembly as set forth in claim 28 wherein said rear wall has a Z-shaped portion partially defining said channel.

30. A rain gutter assembly as set forth in claim 29 wherein said connecting member includes a wall portion spaced beneath said bayonet portion so as to define a slot between said wall portion and said bayonet portion, wherein said bayonet portion and said wall portion are substantially vertically coplanar, and wherein said bayonet portion abuts said outer surface of said rear wall and said wall portion abuts said inner surface of said rear wall.

31. A rain gutter assembly as set forth in claim 30 wherein said Z-shaped portion of said rear wall includes an intermediate portion extending downwardly and inwardly between and in frictional contact with said bayonet and wall portions of said connecting member.

32. A rain gutter assembly as set forth in claim 31 wherein said intermediate portion biases said wall portion of said connecting member against said rear wall of said gutter.

* * * * *